US005176372A

United States Patent [19]

Nakajima

[11] Patent Number: 5,176,372

[45] Date of Patent: Jan. 5, 1993

[54] PAPER PROCESSING APPARATUS

[75] Inventor: Yoshihiro Nakajima, Osaka, Japan

[73] Assignee: Mita Industrial Co., Ltd., Osaka, Japan

[21] Appl. No.: 760,144

[22] Filed: Sep. 16, 1991

[30] Foreign Application Priority Data

Sep. 28, 1990 [JP] Japan ..... 2-262369

[51] Int. Cl.[5] ..... B65H 39/02

[52] U.S. Cl. ..... 270/53; 270/58

[58] Field of Search ..... 270/52, 53, 58, 37

[56] References Cited

U.S. PATENT DOCUMENTS

| | | | |
|---|---|---|---|
| 3,708,160 | 1/1973 | Kantarian et al. | 270/53 |
| 3,744,790 | 7/1973 | Hoffman | 270/58 |
| 3,830,590 | 8/1974 | Harris et al. | 270/58 |
| 3,884,408 | 5/1975 | Leiter et al. | 270/58 |
| 3,944,207 | 3/1976 | Bains | 270/58 |

FOREIGN PATENT DOCUMENTS 58-135059 8/1983 Japan .

*Primary Examiner*—Edward K. Look

*Attorney, Agent, or Firm*—Sandler, Greenblum & Bernstein

[57] ABSTRACT

A paper processing apparatus is provided which includes a sorter for sorting paper discharged from an image forming apparatus into a plurality of bins, each being arranged so that the paper is fed from an upper end of the bin and falls from a lower end of the bin when discharged. A stopper positioned at the lower end of each bin for preventing the paper in the bin from falling, and a stack box for housing the paper dropped from the bin are also provided. A controlling device is provided for controlling the stopper to drop the paper into the stack box by opening the stoppers at substantially the same time after the paper is sorted into the plurality of bins.

11 Claims, 4 Drawing Sheets

START
COPY IS SET
101
COPY IS STARTED
102
103
IS SORT MODE SET?
YES
104
SORT WHEN COPY IS DISCHARGED
109
COPY
105
NO
IS COPY COMPLETED?
YES
106
IS STAPLE MODE SET?
NO
YES
107
STAPLE
108
DROP COPY INTO STACK BOX
END

PAPER PROCESSING APPARATUS

BACKGROUND OF THE INVENTION

1. Field of the Invention

The present invention relates to a paper processing apparatus for sorting or stapling paper discharged from an image forming apparatus, such as, an electrophotographic copying machine.

2. Description of the Prior Art

Conventionally, a paper processing apparatus is known in which paper is sorted into a plurality of bins and where every set of paper is discharged by a carrier belt (for example, Japanese Patent Laid Open No. 58-135059).

However, since the sorted paper is discharged for every set of paper, it takes a long time to discharge the sorted paper and a jam or the like tends to be generated when the paper is discharged.

SUMMARY OF THE INVENTION

According to the present invention, there is provided a paper processing apparatus comprising a sorter for sorting paper discharged from an image forming apparatus into a plurality of bins, each bin being arranged so that the paper may be fed from an upper end of the bin and may fall by itself from a lower end of the bin when discharged, a stopper provided at the lower end of each bin for preventing the paper in the bin from falling, a stack box for housing the paper dropped from the bin, and a controlling device for controlling the stopper to drop the paper into the stack box by opening the stoppers of the bins at the same time after the paper is sorted into the plurality of bins.

The stack box is preferably set at the lower part of the bin so that a falling distance of the paper from the bin may be the same.

A stapler for stapling the sorted paper in each bin may be additionally provided.

Further, it is desirable that the stack box has a transparent part and set so as to be able to be drawn.

DESCRIPTION OF THE PREFERRED EMBODIMENTS

An embodiment of the present invention will be described in reference to the drawings hereinafter. However, the present invention is not limited to this embodiment.

Figure 1:
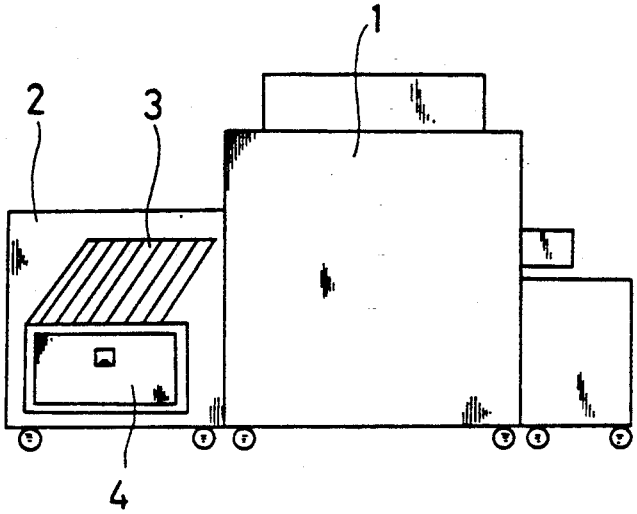
FIG. 1 is a view showing an apparatus in accordance with an embodiment of the present invention.

FIG. 1 is a view showing an apparatus in accordance with an embodiment of the present invention. In FIG. 1, reference numeral 1 designates an electrophotographic copying machine, reference numeral 2 designates a paper processing apparatus, reference numeral 3 designates a sorter and reference numeral 4 designates a stack box for housing paper dropped from the sorter 3.

Figure 2:
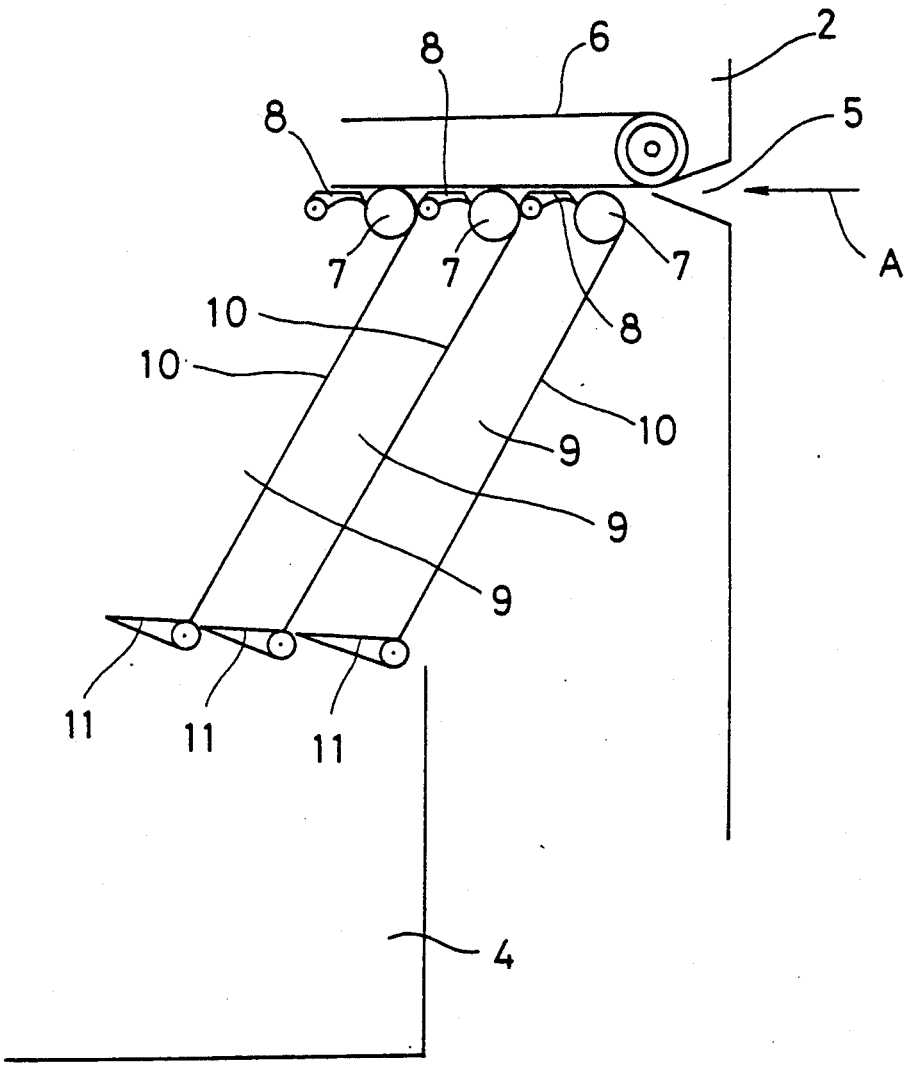
FIG. 2 is a view showing a main part of the apparatus shown in FIG. 1.

FIG. 2 is a view showing a main part of the apparatus shown in FIG. 1. In FIG. 2, reference numeral 5 designates an inlet for receiving paper discharged from the electrophotographic copying machine 1 in a direction shown by arrow A, reference numeral 6 designates a carrier belt for carrying the paper received by the inlet 5 in the direction shown by the arrow A, reference numeral 7 designates a feeding roller for feeding the paper by forcing the paper toward the carrier belt 6, reference numeral 8 designates a sorting lever for sorting the paper, which is provided at an upper end of each bin 9, reference numeral 10 designates a tray provided in each bin and reference numeral 11 designates a stopper lever for preventing the paper housed in the bin 9 from falling, which is provided at a lower end of the bin 9. The paper in each bin 9 falls by itself into the stack box 4 when the stopper lever 11 is opened. In addition, the bin 9 and the stack box 4 are arranged so that a falling distance of the paper from each bin 9 is approximately the same.

Figure 3:
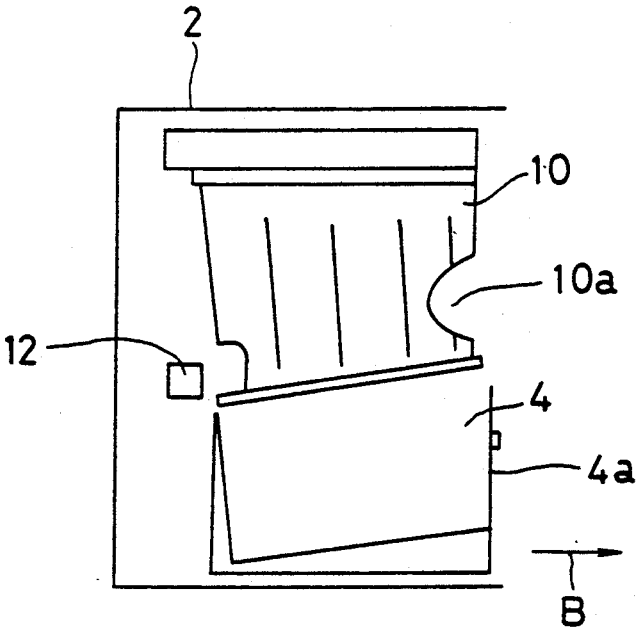
FIG. 3 is a side view showing a main part of the apparatus shown in FIG. 1.

FIG. 3 is a side view showing a main part of the apparatus shown in FIG. 1. In FIG. 3, reference numeral 10*a* designates a notch which is provided at the tray 10 and through which the paper is taken out. The stack box 4 has a transparent plate 4*a* at the front thereof and can be drawn out in a direction shown by arrow B. Reference numeral 12 designates a stapler for automatically stapling the sorted paper in the bin 9. Since the stapler is well known, its description has been omitted.

According to the above structure, the paper copied by the electrophotographic copying machine 1 is sequentially discharged in the direction shown by the arrow A and received by the inlet 5. Then, the paper is carried by the carrier belt 6 and the roller 7 and then sorted by the sorting lever 8 and put into each bin 9. After the sorting operation, the stapler 12 sequentially staples the paper housed in the bin 9. Then, all of the stopper levers 11 are opened at the same time, whereby the paper falls into the stack box 4. At this time, since the falling distance of the paper is set so as to be all the same, the paper can be housed in order in the stack box 4. Further, the stack box 4 has a structure of a drawer as shown in FIG. 3, so that the paper housed therein can be taken out with ease by drawing the stack box 4. Still further, it can be seen whether the paper has fallen through the transparent plate 4*a*.

Although the paper housed in each bin 9 is stapled by the stapler 12 in the above embodiment of the present invention, when the stapler 12 is not used, that is, when the paper is not stapled, it is preferable that the user may take the sorted paper out through the notch 10*a* by hand. The reason for this is that when the paper which is not stapled falls into the stack box 4, the paper could be scattered, so that it takes time to put it in order.

Figure 5:
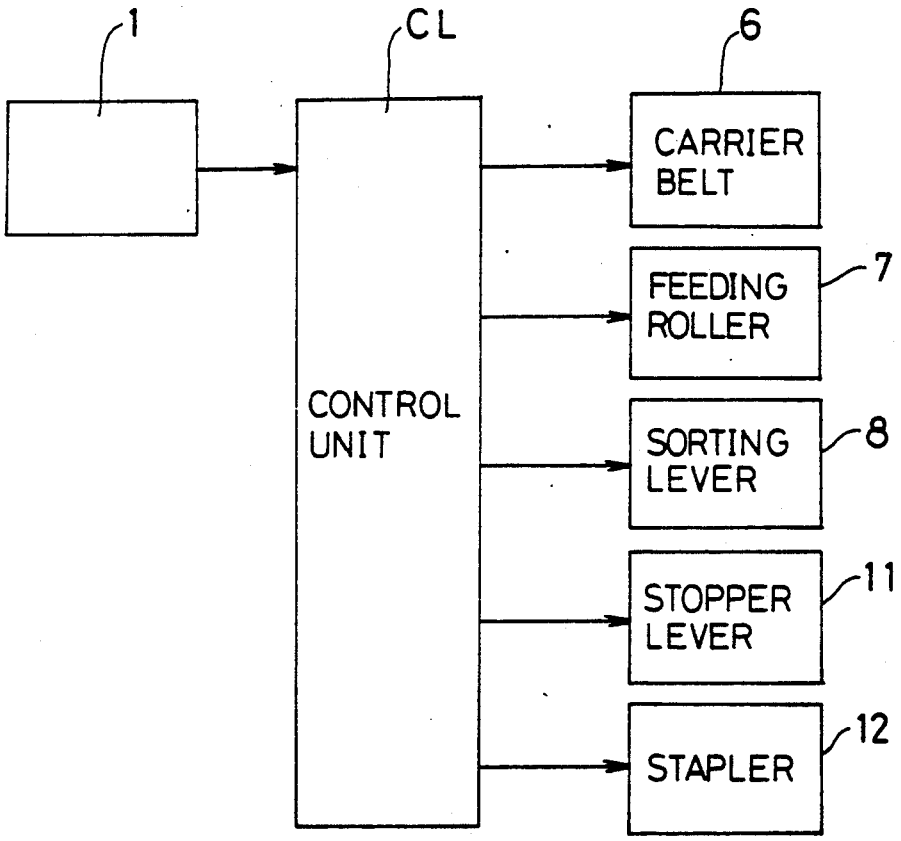
FIG. 5 is a block diagram showing a controlling part of the apparatus of the embodiment of the present invention shown in FIG. 1.

FIG. 5 is a block diagram showing a control part of this embodiment of the present invention. Referring to FIG. 5, a control unit CL receives various signals from the electrophotographic copying machine 1 and then drives the carrier belt 6, the feeding roller 7, the sorting lever 8, the stopper lever 11 and the stapler 12.

Figure 4:
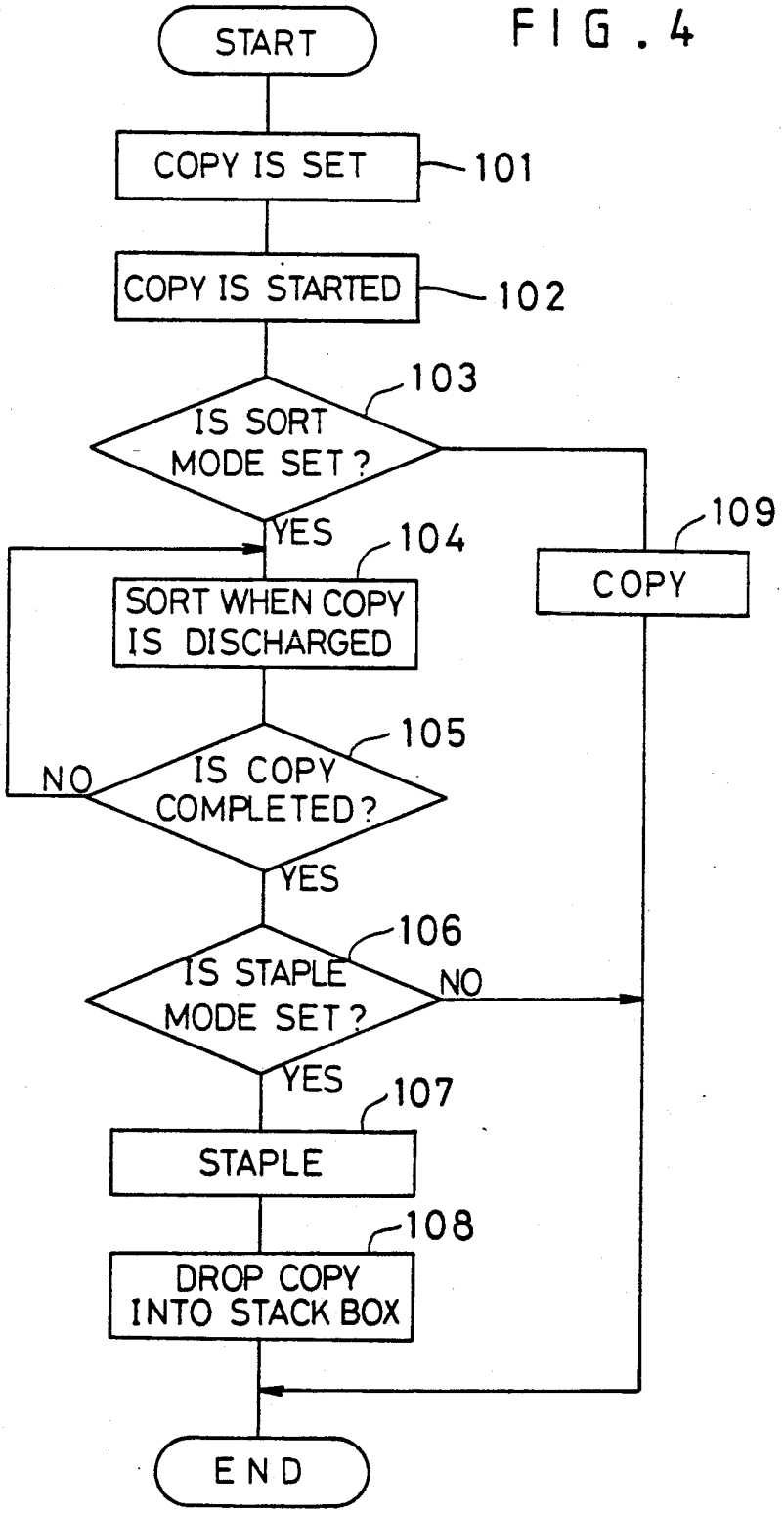
FIG. 4 is a flowchart for describing operation of the apparatus shown in FIG. 1.

FIG. 4 is a flowchart for describing operation of the embodiment shown in FIG. 1 (each operation in the flowchart is performed by operating parts (not shown) of the electrophotographic copying machine).

A copy is set in step 101 and then started in step 102. Then, it is determined whether a sort mode is set or not in step 103. If the sort mode is set, then in step 104 the paper is sorted when discharged. Thereafter, if it is determined that the copy is completed in step 105, then it is determined whether a staple mode is set or not in step 106.

When the staple mode is set, the sorted paper in each bin 9 is stapled by the stapler 12 in step 107. Then, all paper in each bin 9 is stapled, and the paper is dropped into the stack box 4 in step 108.

Meanwhile, if it is determined that the staple mode is not set in step 106, all operation is finished at that time and then the sorted paper is taken out from the bin 9 by the user. Furthermore, if it is determined that the sort mode is not set in step 103, then all copied paper is housed in any one of bins of the sorter 3 in step 109.

According to the present invention, paper sorted by the sorter can be taken out with ease in a considerably shorter time and trouble such as a jam is not generated.

While only certain presently preferred embodiments have been described in detail herein, as will be apparent to those skilled in the art, certain changes and modifications can be made without departing from the scope of the invention as defined by the following claims.

What is claimed is:

1. A paper processing apparatus comprising:

a sorter for sorting paper discharged from an image forming apparatus into a plurality of bins, each of said plurality of bins being arranged so that the paper is fed from an upper end of said bin and falls from a lower end of said bin when discharged;

a stopper provided at the lower end of each of said plurality of bins for preventing the paper in said bin from falling;

a stack box for stackably housing the paper dropped from said plurality of bins, said stack box comprising a single opening extending across said plurality of bins for receiving the paper dropped from said bins; and controlling means for controlling said stopper to drop the paper into said stack box by opening said stoppers of said bins at substantially the same time after the paper is sorted into said bins.

2. A paper processing apparatus according to claim 1, wherein said stack box is positioned at the lower part of said bins so that a falling distance of the paper from said bins is substantially the same.

3. A paper processing apparatus according to claim 1, further comprising a stapler for stapling the sorted paper in said bins.

4. A paper processing apparatus according to claim 1, wherein said stack box further comprises has a transparent portion and is arranged to be drawn out from the paper processing apparatus to remove the paper stacked therein.

5. A paper processing apparatus comprising:

sorter means for sorting paper into a plurality of bins, each of said plurality of bins comprising stopping means for preventing the paper in said bin from being discharged therefrom;

housing means for stackably housing the paper discharged from said plurality of bins, said housing means comprising a single opening extending across said plurality of bins for receiving the paper dropped from said bins; and controlling means for controlling said stopping means to release the paper in said bins at a predetermined time after the paper is sorted into said bins.

6. A paper processing apparatus according to claim 5, wherein said sorter means further comprises feeding means for feeding the paper at an upper end of said bins and sorting members provided at said upper end of said bins for sorting the paper into said bins.

7. A paper processing apparatus according to claim 6, wherein said controlling means controls said feeding means and said sorting members of said sorter means for sorting the paper into said bins.

8. A paper processing apparatus according to claim 5, wherein said housing means further comprises a stack box that is positioned at a lower end of said bins to receive the paper discharged from said bins.

9. A paper processing apparatus according to claim 6, further comprising stapler means for stapling the paper in said bins.

10. A paper processing apparatus according to claim 5, wherein each of said bins comprises a tray, said tray comprising an opening through which the paper in said bin can be removed.

11. A paper processing apparatus according to claim 8, wherein said stack box comprises a transparent portion for viewing the paper stacked therein and removing means for removing the stacked paper.

* * * * *

UNITED STATES PATENT AND TRADEMARK OFFICE

CERTIFICATE OF CORRECTION

PATENT NO. : 5,176,372

DATED : January 5, 1993

INVENTOR(S) : Y. NAKAJIMA

It is certified that error appears in the above-indentified patent and that said Letters Patent is hereby corrected as shown below:

At column 4, line 5 (claim 4, line 2), delete "has" after "comprise".

Signed and Sealed this

Ninth Day of August, 199

*Attest:*

*Attesting Officer*

Bruce Lehman

BRUCE LEHMAN

*Commissioner of Patents and Trademarks*